United States Patent [19]

Griswold

[11] Patent Number: 4,706,983

[45] Date of Patent: Nov. 17, 1987

[54] ASSEMBLY FOR TOWING A BOAT

[76] Inventor: Wayne D. Griswold, 194 Screenland Dr., Burbank, Calif. 91505

[21] Appl. No.: 839,108

[22] Filed: Mar. 13, 1986

[51] Int. Cl.[4] ..... B63C 13/00

[52] U.S. Cl. ..... 280/414.2; 114/344; 280/47.13 B

[58] Field of Search ..... 280/414.1, 414.2, 47.13 B; 114/344

[56] References Cited

U.S. PATENT DOCUMENTS

| | | | |
|---|---|---|---|
| 2,484,346 | 10/1949 | Iorns | 114/344 |
| 3,337,243 | 8/1967 | Rued | 280/414.2 |
| 4,300,252 | 11/1981 | Montooth | 280/414.2 |
| 4,344,635 | 8/1982 | Welton | 280/414.2 |

*Primary Examiner*—John J. Love
*Assistant Examiner*—Donn McGiehan
*Attorney, Agent, or Firm*—John E. Wagner

[57] ABSTRACT

An assembly for towing a boat includes a pair of channel members mounted on the transom of the boat and a towing socket fastened to the prow of the boat for attachment to a tow ball formed as part of an upstanding hitch carried on a tow vehicle. A pair of leaf spring supports each carry wheels and stub axles and are pinned to the channel members by means of pivot pins and other removable pins which hold the supports firmly in the channels when the removable pins are in place, which holds the wheels firmly in the lowered position for towing and which permit the supports and wheels to be rotated around the pivot pins to store the wheels when the removable pins are removed. Each of the stub axles includes a hollow extension which supports at its outboard end a rod or shaft serving as a stabilizing bar and the stabilizing bars are held in axial alignment by means of a stabilizing retaining tube supporting the stabilizing bars at their inboard ends.

10 Claims, 12 Drawing Figures

FIG. 4.
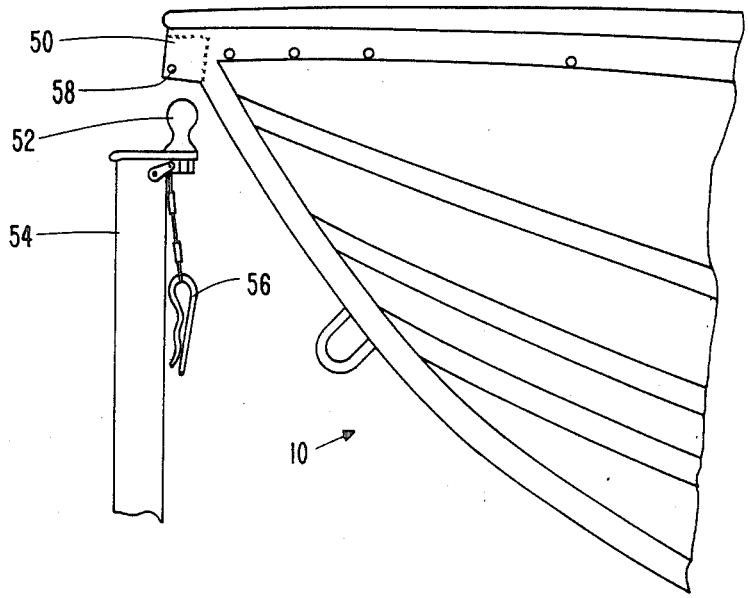
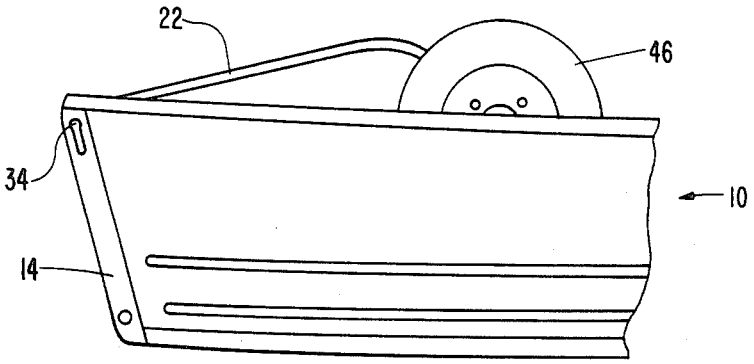
FIG. 5.
FIG. 6.
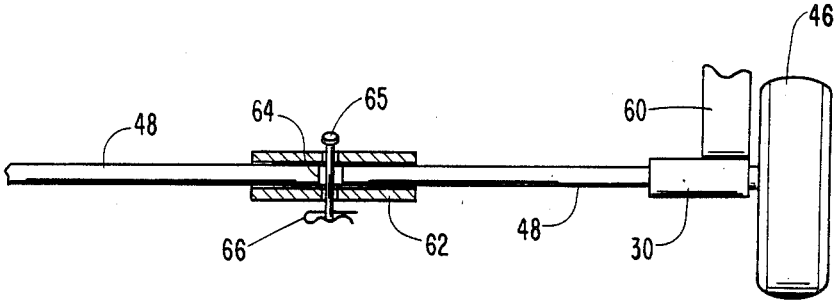
FIG. 7.
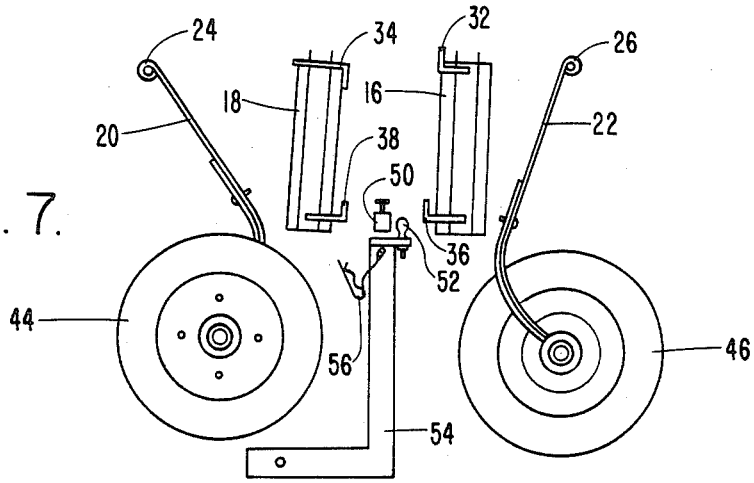

ASSEMBLY FOR TOWING A BOAT

BRIEF SUMMARY OF THE INVENTION

This invention relates to an assembly for towing a boat behind a vehicle. The boat towing assembly of the invention is characterized by the provision of a simple vehicle hitch attached to the prow of the boat and a carriage mounted to the transom at the rear of the boat including a pair of spaced, vertically oriented channel members attached to the transom, a pair of leaf spring supports which curve toward the rear having rolled loops or sleeves at each end, carried in the channel members and pivotally attached to the channel members by means of pivot pins. A pair of wheels with stub axles are carried in the lower sleeves of the leaf spring supports with the stabilizing bar retainers extending a substantial distance inwardly of the supports. For transporting a boat at any significant speed, a stabilizing bar member is fitted coaxially over or within the stub axles to prevent misalignment of the wheels through twisting of the leaf spring supports. Removable pins at the lower ends of the channel members secure the supports in the normal downwardly extending position for towing and are removed when the boat is floated to permit the wheels and supports to be pivoted around the pivot pins. The wheels may then be stored in the boat with the pivot pins attached, or the pivot pins may be removed to permit the wheels, axles and supports to be stored elsewhere.

BACKGROUND OF THE INVENTION

Boats of small size and even boats of considerable size are frequently towed along roads and highways to and from a body of water and this towing typically requires a towing vehicle and a suitable hitch for attachment to a trailer which carries the boat. Frequently the trailer is designed to be backed into the water by the towing vehicle and the boat is floated free of the trailer. Such trailers are heavy, somewhat expensive and they tend to be deteriorated with repeated submerging. Trailers also tend to cause damage to the carried boat with repeated trailering because they usually support the boat along the hull where boats are least sturdy. A number of arrangements have been taught for making it possible to load, carry, and unload small boats from the top of a car, truck or camper. Such systems are practical if the boat is not too heavy, but they normally require structure for lifting the boat up and down and also a dolly for moving the boat to the water once it is removed from the carrying vehicle. Such a design is shown in U.S. Pat. No. 3,445,018 to Reagan. Applicant's copending application Ser. No. 529,047 also shows a car top carrier design. Other special dolly and tow bar arrangements have been devised for moving a small boat for short distances by means of a towing vehicle but are not intended for high speed highway towing or for towing over rough terrain. Such structures are shown in U.S. Pat. Nos. 4,392,665 and 4,344,635 to Miller et al and Welton, respectively. None of the foregoing really deal with the problem of transporting a boat at highway speeds without requiring the lifting devices and dolly of the boat carrying arrangements or the expense and damage problems connected with repeated trailering on the usual boat trailer.

DESCRIPTION OF THE DRAWINGS

FIG. 4 is a partial side view of the front of a boat and towing hitch, according to my invention;

FIG. 5 is a partial side view of a boat with a towing wheel and support stowed in the boat while in the water;

FIG. 6 is a view from the rear, partly in section, of a part of my towing assembly including details of the stabilizing bars and stabilizing bar retainers used for highway travel;

FIG. 7 is a plan view of the principal parts used in a towing device according to my invention;

DESCRIPTION OF THE PREFERRED EMBODIMENTS

Figure 1:
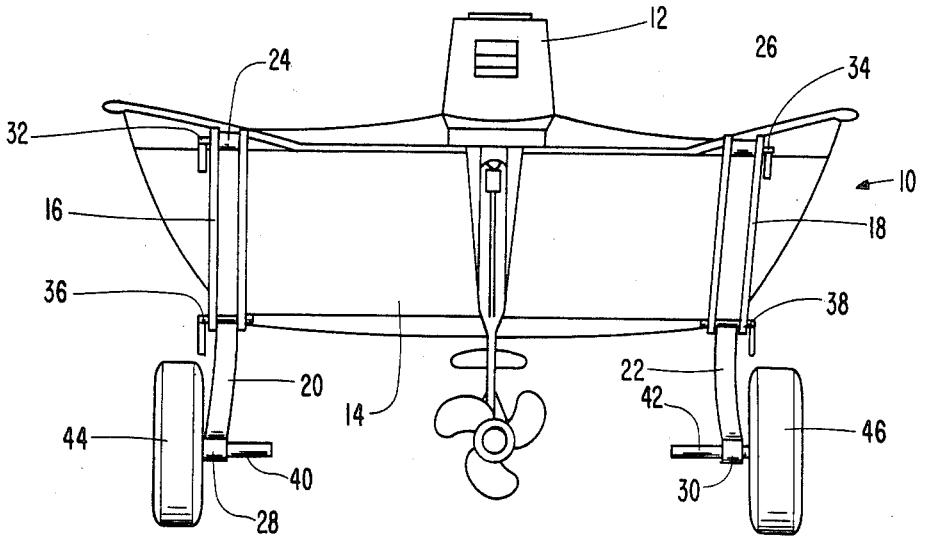
FIG. 1 is a view of a boat from the rear ready for launching with the towing wheels and supports of my invention attached.

Referring now to FIG. 1, a boat 10 is shown as seen from the rear carrying an outboard motor 12. Attached to the transom 14 of the boat are a pair of vertically oriented metal channel members 16 and 18 and carried within said channel members are a pair of leaf spring supports 20 and 22. Supports 20 and 22 are formed with loops or sleeves 24 and 26 at their top ends and similar but larger sleeves 28 and 30 at their lower ends, respectively. Support 20 is carried on a removable pivot pin 32 which is inserted through the sleeve 24 and drilled holes in the upper end of this support member. Similarly, support member 22 is carried on a removable pivot pin 34 which is inserted through the flanges of channel member 18 and sleeve 26. Similar holes are drilled through the flanges of channel members 16 and 18 near the bottom of transom 14 and these holes receive removable pins 36 and 38, respectively, which, when in position as shown, secure the supports 20 and 22 in their respective channels. Sleeves 28 and 30 contain hollow stub axle members 40 and 42, respectively, supporting wheels 44 and 46, respectively. Sleeves 28 are sized and arranged to accommodate suitable bearings or, alternatively, such bearings may be incorporated in hub structures of wheels 44 and 46.

Figure 2:
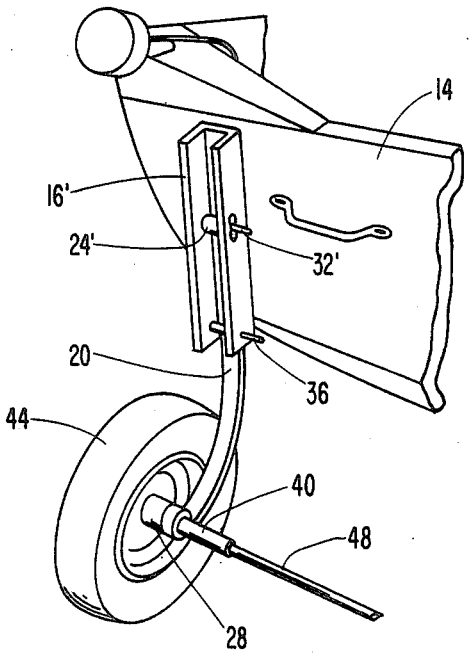
FIG. 2 is a perspective view of a fragmentary portion of a boat with a modified form of my invention with the stabilizing bar attached for highway transportation.
Figure 3:
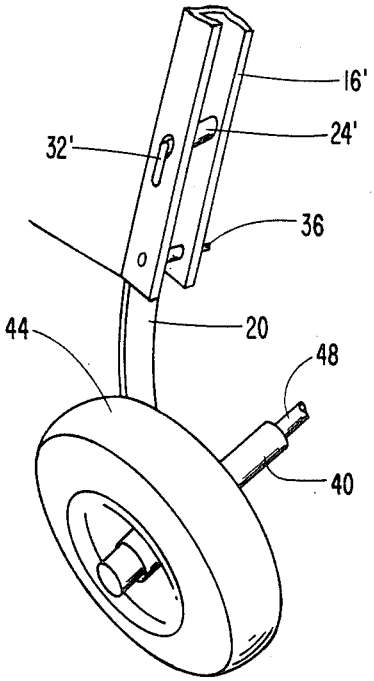
FIG. 3 is a perspective view of the structure of FIG. 2 as viewed from the opposite side of the wheel.

FIG. 2 is a perspective view of a portion of the boat structure shown in FIG. 1 but with a slight modification to the towing assembly. Transom 14 is as shown as are leaf spring support member 20, sleeve 28, stub axle 40, and wheel 44. A removable pin 36 is located and arranged essentially as described above, but the channel member itself is now shown as channel 16' and is shorter that than described with respect to FIG. 1 and has the pivot pin 32' and sleeve 24' located at a significant distant down from the top of the channel. Stub axles 40 and 42 which support wheels 44 and 46 are made hollow at their extensions so that they may receive a stabilizing bar 48 which is inserted into the hollow interior of the stub axles for use in towing at any significant speed since this stabilizing bar acts as a vibration damper to prevent shimmying of the wheels 44 and 46 and causing them to maintain proper forward alignment. This stabilizing bar may be dispensed with for limited maneuvering around a marina or launching ramp. FIG. 3 is another view of the structure shown in FIG. 2 but as seen from the outside of wheel 44.

FIG. 4 is a partial side view of the front of the boat showing a towing socket 50 which is built into the prow of the boat and which socket is adapted to mate with and cover a towing ball 52 mounted on an upstanding post 54 forming part of a conventional hitch structure. A key member 56 is provided for insertion into a passageway 58 in socket 50 to thereby confine ball 52 within socket 50.

As described above, it is an objective of the present invention to provide a towing arrangement whereby the carrying wheels may be held in position for towing as shown in FIG. 1 and then, after launching, the removable pins 36 and 38 are removed and the support members 20 and 22 may be rotated around the pivot pins 32 and 34 to place the wheels 44 and 46 within the interior of the boat hull. They may then be stored there if desired or, alternatively, the pivot pins may be removed and the wheels and support members stowed elsewhere. FIG. 5 shows a side view (partial) of the rear of boat 10 with the wheel 46 and support 22 rotated approximately 270 degrees such that wheel 46 is stowed with the hull of boat 10.

Essential parts of my boat towing assembly are shown in FIGS. 6 and 7. FIG. 6 is a view from the rear of a portion of my assembly showing details of the stabilizing bars and retaining means. In this view wheel 46 is shown supported by stub axle 42 in sleeve 30. The stub axle 42 is hollow and receives the stabilizing bar 48' which is loosely fitted within the extension of stub axle 42 which also serves as a stabilizer bar retainer. A stabilizing retaining tube 62 retains the inner ends of stabilizer bars 48 and 48' and is held in position by means of a removable retaining pin 64 carried in a transverse bore 65. A removable key 66 prevents pin 64 fom backing out of the retaining tube 62.

In FIG. 7 are shown the separate channel members 16 and 18 which are to be attached to the boat transom 14 and each of these members includes removable pins 36 and 38 and the pivot pins 32 and 34, respectively. Also shown are wheels 44 and 46 with their respective leaf spring supports 20 and 22. On leaf spring supports 20 and 22 are shown the rolled sleeves 24 and 26. The hitch structure is shown including the L-shaped upstanding post member 54 which is attached to a towing vehicle and which supports the ball 52 and carries the key member 56 which secures ball 52 in the socket member 50 which is attached to the prow of the boat.

Figure 8:
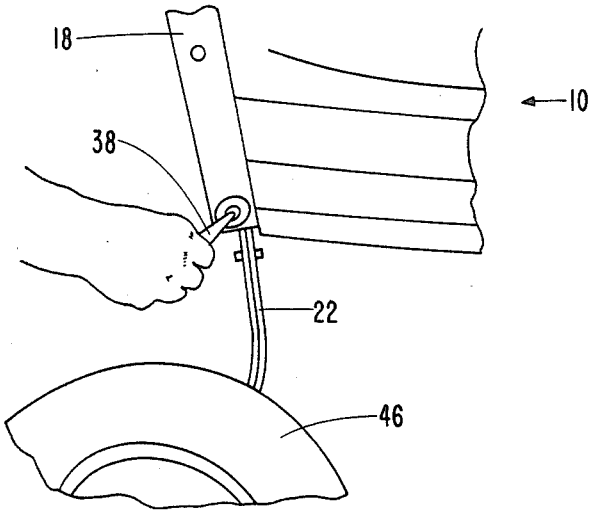
FIG. 8 is a partial side view of a boat equipped with a towing assembly incorporating my invention and showing the removable pin in the process of releasing the tension on the wheel spring before the boat is put in the water.

FIGS. 8 through 12 show a series of steps for placing the boat 10 in a condition to operate in the water. In FIG. 8 is shown the lower portion of the rear of boat 10 prior to launching including a side view of the channel member 18 showing the removable pin 38 which is a cam locking pin which confines the leaf spring support 22 and holding wheel 46 in its towing position. With the removable cam locking pins 36 and 38 in position, the leaf spring supports 20 and 22 are held firmly against the channel members which serve to stabilize the leaf spring supports 20 and 22 when the boat is being towed. This minimizes twisting of the supports so that the wheels are kept in alignment during towing. Thus the leaf spring supports are permitted to flex in the vertical plane, permitting the wheels 44 and 46 to move up and down, but very little turning movement is permitted such as would result from twisting of the leaf spring supports. Pins 36 and 38 are relatively stiff when in locked position for towing and are not conveniently operated in the water. They need to be rotated to a flat side to release the force against the leaf spring supports 20 and 22 before launching the boat.

Figure 10:
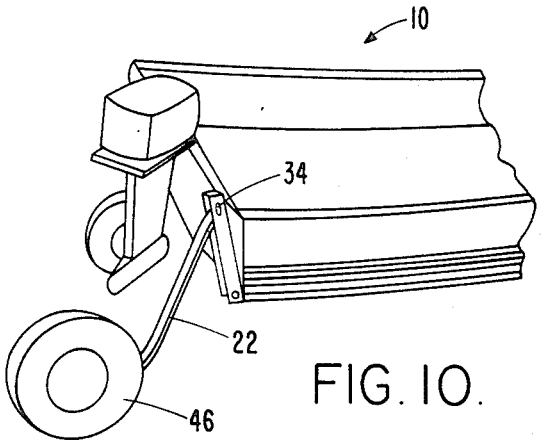
FIG. 10 is a view showing the boat of FIGS. 7 and 8 with one wheel and leaf spring support partially pivoted around its pivot pin as the wheel is floated toward the surface.
Figure 9:
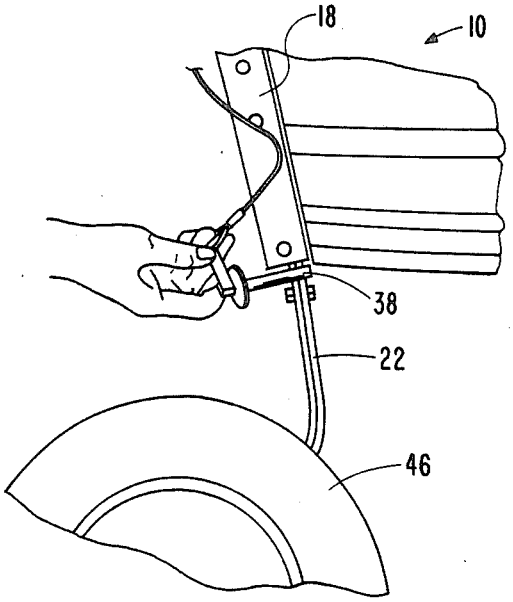
FIG. 9 is a view similar to FIG. 8 but with the removable pin completely removed after the boat is placed in the water.
Figure 11:
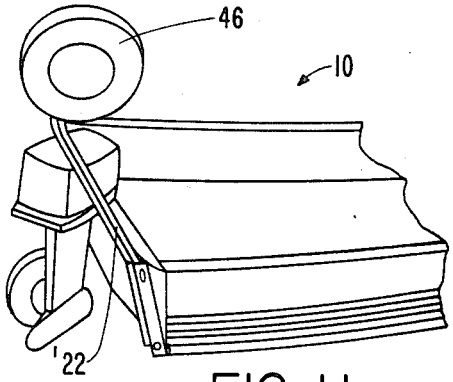
FIG. 11 is a view similar to FIG. 9 but with the leaf spring support rotated approximately 180 degrees.
Figure 12:
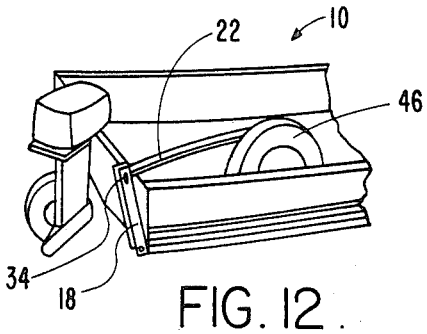
FIG. 12 is a view similar to FIGS. 9 and 10 but with the leaf spring support rotated approximately 270 degrees to place the wheel in storage within the boat.

In FIG. 9 the same parts are shown and the removable pin 38 has been removed from the ports in channel member 18 in which it is normally placed and where it secures the support 22. In FIG. 10 the support 22 has begun to be rotated around the pivot pin 34 and it will be seen that the wheel 46 and support 22 are no longer confined against the transom of the boat 10. In FIG. 11 the same parts are shown with the wheel 46 rotated approximately 180 degrees from its original position and with support 22 similarly rotated such that wheel 46 is shown extending almost vertically above the boat 10. In FIG. 12 the leaf spring support 22 and wheel 46 have been further rotated a total of approximately 270 degrees such that the wheel 46 is now stowed within the hull of boat 10.

From the foregoing it will be recognized that I have devised a boat towing assembly which is quite light and relatively inexpensive, which supports the boat at its points of greatest structural strength, i.e. the transom and the prow, and which is quite convenient to convert from a highway towing situation to operation in the water and vice versa. Since the wheels and their support members weigh only about 25 lbs. each, they can easily be handled by a youth or a woman. The embodiment shown in FIGS. 1, 5 and 8 through 12 locates the pivot pin at the top end of the channel members such that the wheels and supports may be rotated to stow these parts within the hull if desired. This arrangement would conveniently permit the boat to be stored by suspending it from a garage ceiling with the wheels folded into the boat. The embodiment shown in FIGS. 2 and 3, in which the pivot pin is located lower in the channel members, may be used where the first described arrangement is not a structural practicality or where there is interference on the boat preventing use of this storage arrangement. With the structure of FIGS. 2 and 3 its operation is essentially the same, in which the removable pins 36, 38, can be removed to permit the support members 20 and 22 and the wheels 44 and 46 to be rotated such that they stand essentially vertically over the rear of the boat somewhat as is shown in FIG. 10 but cannot be rotated farther. With either arrangement it may be preferred to remove the pivot pins 32 and 34 and simply store the wheels and supports elsewhere. Other modifications will occur to those skilled in the art. As suggested above, bearings for the wheels may be located within the hubs of the wheels or within the sleeves 28, 30. The axle extension 48 may be of small diameter and placed within a hollow axle such as that shown at 40 in FIG. 2 or FIG. 3 or this axle may be of larger diameter and may telescope over the stub axle members 40 and 42. The arrangement shown is, however, smaller and lighter.

I claim:

1. An assembly for towing a boat behind a vehicle, said vehicle including a towing hitch having an upstanding post, said boat including connecting means at its prow for attachment to said hitch, and a transom, characterized in that the rear of said boat is supported on a carriage comprising a pair of spaced, vertically oriented channel members attached to said transom and extending essentially the height of said transom, a pivot pin extending through the sides of each of said channel members at the top of said channel members and a removable pin extending through the flanges of each of said channel members near the lower end thereof, first and second elongated leaf spring supports carried in respective channel members and extending a substantial distance below said channel members and curving toward the rear relative to forward motion of said boat, said supports each having a sleeve at each end thereof, with said pivot pins extending through the upper ones of said sleeves, a pair of stub axles and highway wheels supported on said axles with each of said axles carried in the lower ones of said sleeves, said axles extending a substantial distance inwardly of said leaf spring supports, a removable stabilizing extension member coaxially connected between the extensions of said stub axles permitting limited axial movement of said wheels while preventing shimmying movement of said wheels, such that when said removable pins are in place, said leaf spring supports are confined and said wheels remain below and support said boat and when said removable pins are removed, said leaf spring supports are permitted to pivot around said pivot pins to a second position substantially within the boat.

2. An assembly for towing a boat as claimed in claim 1 wherein said leaf spring support is sufficiently flexible in the axis of rotation of said wheel to provide resilient support for said boat while it is being towed.

3. An assembly for towing a boat as claimed in claim 1 wherein said supports are curved rearward approximately the radius of the wheel and wherein said wheels and supports are rotatable such that said wheels may be carried in said boat.

4. An assembly for towing a boat as claimed in claim 1 wherein after removing said removable pins and said supports have been pivoted to said second position, said pivot pins may be removed for storage of said wheels and supports.

5. An assembly for supporting the rear of a boat having a transom and which is to be towed over roads, said device including a vertically oriented channel member attached to said transom and extending essentially to the top of said channel, a pivot pin at the top of said channel member and extending through the flanges of said channel member, an elongated leaf spring support carried in said channel member extending a substantial distance below said transom and curving toward the rear relative to forward motion of said boat, said support including a rolled sleeve at its top end with said pivot pin extending through said sleeve, a removable pin extending through the flanges of said channel member near its lower end confining said support member, an axle and a wheel supported on said axle carried at the lwoer end of said leaf spring support at a first position for towing whereby said removable pin may be removed to permit said leaf spring support to be pivoted around said pivot pin to a second position approximately 270° from said first position substantially within the boat.

6. An assembly for towing a boat as claimed in claim 5 wherein said leaf spring supports are sufficiently flexible in the axis of rotation of said wheels to provide resilient support for said boat while it is being towed.

7. An assembly for towing a boat as claimed in claim 5 wherein said support is curved rearward approximately the radius of the wheel and after removing said removable pin, said wheel may be pivoted on said support and stored in said boat.

8. An assembly for towing a boat as claimed in claim 5 wherein after removing said removable pin and said support has been pivoted to said second position, said pivot pin may be removed for removal and storage of said wheel and said support.

9. An assembly for towing a boat behind a vehicle having a towing hitch, said boat having a transom and towing means attached to its prow for connection to said hitch, characterized in that the rear of said boat is supported on a carriage comprising a pair of spaced, vertically oriented channel members attached to said transom and extending essentially the height of said transom, a pivot pin extending through the sides of each of said channel members at the top thereof and a removable pin extending through the flanges of each of said channel members near the lower end thereof, first and second elongated leaf spring supports carried in said chennal members and extending a substantial distance below said channel members and and curving toward the rear relative to forward motion of said boat, said supports each having a sleeve at each end thereof, with said pivot pins extending through the upper sleeves, a pair of stub axles and wheels supported on said stub axles with each of said axles carried in the lower sleeves, said axles extending a substantial distance inwardly of said leaf spring supports, a removable stabilizing bar coaxially connected between the extensions of said axles permitting limited axial movement of said wheels while preventing shimmying movement of said wheels, such that when said removable pins are in place, said leaf spring supports are confined and said wheels remain below and support said boat and when said removable pins are removed, said leaf spring supports are permitted to pivot around said pivot pins to a second position.

10. A device for towing a boat as claimed in claim 9 wherein said stabilizing bars are supported and retained at their inner ends by means of a stabilizing retaining tube, said tube including a transverse bore therethrough and a removable retaining pin for preventing significant axial movement of said retaining tube.

* * * * *